US011247356B2

(12) United States Patent
Broemse et al.

(10) Patent No.: US 11,247,356 B2
(45) Date of Patent: Feb. 15, 2022

(54) SHAVING RAZOR SYSTEM

(71) Applicant: The Gillette Company LLC, Boston, MA (US)

(72) Inventors: Norbert Broemse, Bad Homburg (DE); Klaus Heubach, Koenigstein (DE); Maurice Schirmer, Schwalbach am Taunus (DE)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/367,338

(22) Filed: Mar. 28, 2019

(65) Prior Publication Data

US 2019/0358837 A1 Nov. 28, 2019

Related U.S. Application Data

(60) Provisional application No. 62/650,386, filed on Mar. 30, 2018.

(51) Int. Cl.

| | |
|---|---|
| ***B26B 21/48*** | (2006.01) |
| ***B26B 21/22*** | (2006.01) |
| ***B26B 21/40*** | (2006.01) |
| ***B26B 21/52*** | (2006.01) |

(52) U.S. Cl.

CPC ..... *B26B 21/48* (2013.01); *B26B 21/225* (2013.01); *B26B 21/405* (2013.01); *B26B 21/4012* (2013.01); *B26B 21/526* (2013.01)

(58) Field of Classification Search

CPC ... B26B 21/48; B26B 21/225; B26B 21/4012; B26B 21/521; B26B 21/405; B26B 21/526; B26B 21/52

See application file for complete search history.

(56) References Cited

U.S. PATENT DOCUMENTS

| | | | | |
|---|---|---|---|---|
| 2,622,319 | A * | 12/1952 | Hunt | B26B 21/48 30/34.05 |
| 3,593,416 | A * | 7/1971 | Edson | B26B 21/14 30/50 |
| 6,836,966 | B2 * | 1/2005 | Patrick | B26B 19/382 30/140 |
| 7,681,320 | B2 * | 3/2010 | Szczepanowski | B26B 21/38 30/530 |
| 7,743,506 | B2 * | 6/2010 | Szczepanowski | B26B 21/446 30/34.05 |
| 9,149,945 | B2 * | 10/2015 | Tomassetti | B26B 21/48 |
| 9,604,375 | B2 * | 3/2017 | Bohmer | B26B 21/48 |
| 2006/0032055 | A1 * | 2/2006 | Simms | B26B 21/4056 30/34.05 |
| 2006/0037197 | A1 * | 2/2006 | Hawes | B26B 21/44 30/45 |

(Continued)

OTHER PUBLICATIONS

International Search Report for PCT/US2019/023580 dated Mar. 22, 2019, 13 pages.

*Primary Examiner* — Jonathan G Riley
(74) *Attorney, Agent, or Firm* — John M Lipchitz

(57) ABSTRACT

A shaving razor system with a handle and a shaving razor cartridge mounted to the handle. A flexible electrical bridge with a portion positioned within the handle extends from the handle to the shaving razor cartridge. The flexible electrical bridge has a loop between the shaving razor cartridge and the handle.

20 Claims, 11 Drawing Sheets

(56) References Cited

U.S. PATENT DOCUMENTS

| | | | | |
|---|---|---|---|---|
| 2006/0070242 | A1* | 4/2006 | Szczepanowski | B26B 21/48 30/140 |
| 2009/0071010 | A1 | 3/2009 | Hart | |
| 2012/0291288 | A1* | 11/2012 | Bohmer | B26B 21/48 30/34.05 |
| 2015/0032128 | A1* | 1/2015 | Tavlin | A61N 7/02 606/131 |
| 2015/0197019 | A1 | 7/2015 | Hodgson | |
| 2015/0298326 | A1* | 10/2015 | Tomassetti | B26B 21/48 30/34.05 |
| 2016/0121496 | A1 | 5/2016 | Johnson | |
| 2017/0112002 | A1 | 4/2017 | Behrendt | |

* cited by examiner

SHAVING RAZOR SYSTEM

FIELD OF THE INVENTION

The present invention relates to personal care products and more particularly to wet shaving razors having a flexible electrical bridge.

BACKGROUND OF THE INVENTION

Users of wet-shave razors generally appreciate a feeling of warmth against their skin during shaving. The warmth feels good, resulting in a more comfortable shaving experience. Various attempts have been made to provide a warm feeling during shaving. For example, shaving creams have been formulated to react exothermically upon release from the shaving canister, so that the shaving cream imparts warmth to the skin. Also, various ways of delivering heat through the razor cartridge have also been proposed in the patent literature. It has also been proposed in the patent literature to heat the blades, which may decrease the force required to cut the hair. Additional electronic components may be required to deliver heat to the skin in a safe and reliable manner. Furthermore, electronic components must be small to fit within a consumer appliance, such as a razor. Accordingly, electrical components and fittings are typically very delicate and can break easily. Electricity typically must be delivered from a power source (e.g., a battery) positioned in the handle to a cartridge that pivots relative to the handle. The cartridge should pivot without impacting the electrical connections. However, this can be challenging because the cartridge may need to pivot over a thousand cycles over its lifetime. In addition, the electrical connection between the handle and the cartridge may negatively impact the pivoting forces of the cartridge by providing additional biasing forces.

Accordingly, there is a need to provide a flexible electrical connection between a handle and a cartridge of a shaving razor system that allows for efficient pivoting of the cartridge while also providing a reliable electrical connection.

SUMMARY OF THE INVENTION

The invention features, in general, a simple, shaving razor system having a handle and a shaving razor cartridge mounted to the handle. A flexible electrical bridge has a portion positioned within the handle and extends from the handle to the shaving razor cartridge. The flexible electrical bridge has a loop between the shaving razor cartridge and the handle.

The invention also features, in general, a shaving razor system having a handle and a shaving razor cartridge mounted to the handle. A flexible electrical bridge is positioned partially within the handle. The flexible electrical bridge has a first bend with a concave bottom surface in a neutral position, second bend with a concave bottom surface in the neutral position and a loop with a concave top surface in the neutral position. The loop is between the first bend and the second bend.

The invention also features, in general, a simple, efficient assembly method for a shaving razor by positioning a circuit board within a handle. A first end of a flexible electrical bridge is connected to the circuit board. A second end of the flexible electrical bridge is connected to a heating element. A loop is formed in the flexible electrical bridge by bending the flexible electrical bridge.

The invention also features, in general, a shaving razor system having a handle and a shaving razor cartridge mounted to the handle. The shaving razor cartridge has a primary pivot axis. A flexible electrical bridge having a loop is positioned between the shaving razor cartridge and the handle. The flexible electrical bridge is positioned partially within the handle and partially within the shaving razor cartridge. A cartridge entry point of the flexible electrical bridge is positioned below the primary pivot axis.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
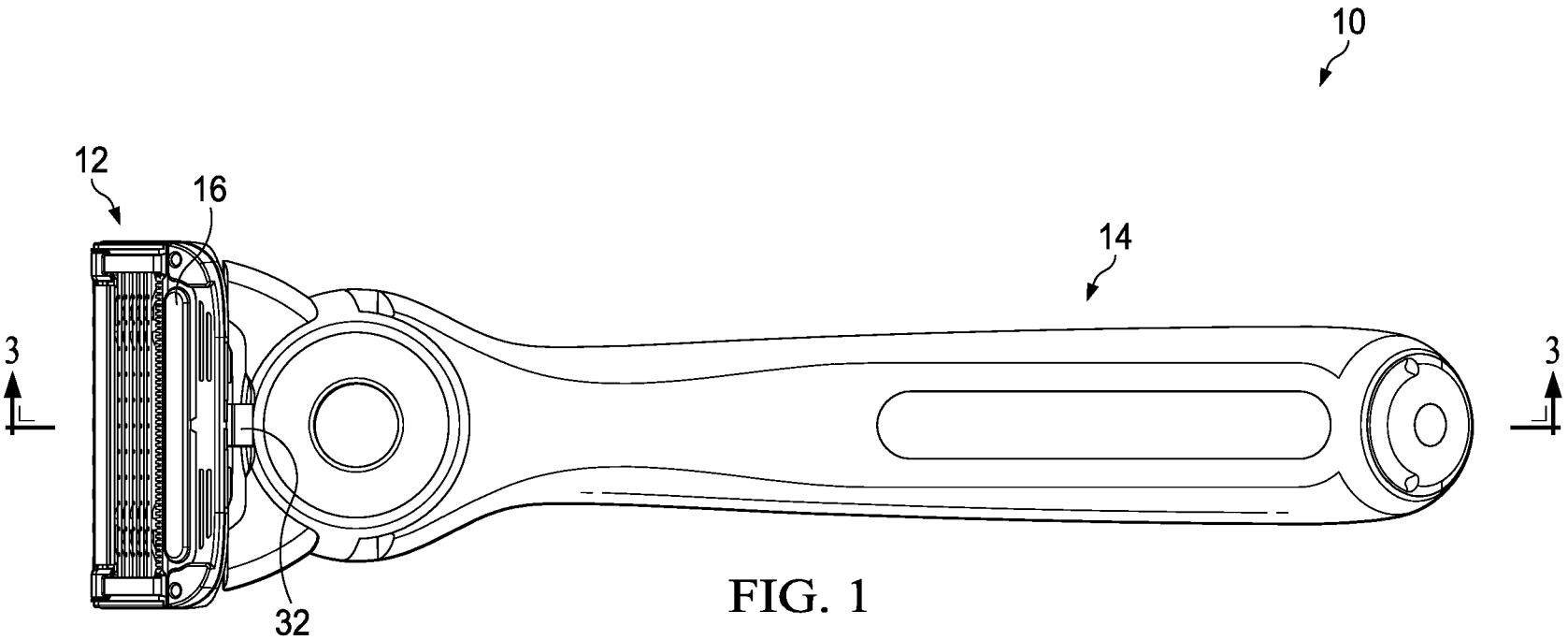
FIG. 1 is a bottom view of one possible embodiment of a shaving razor system.
Figure 2:
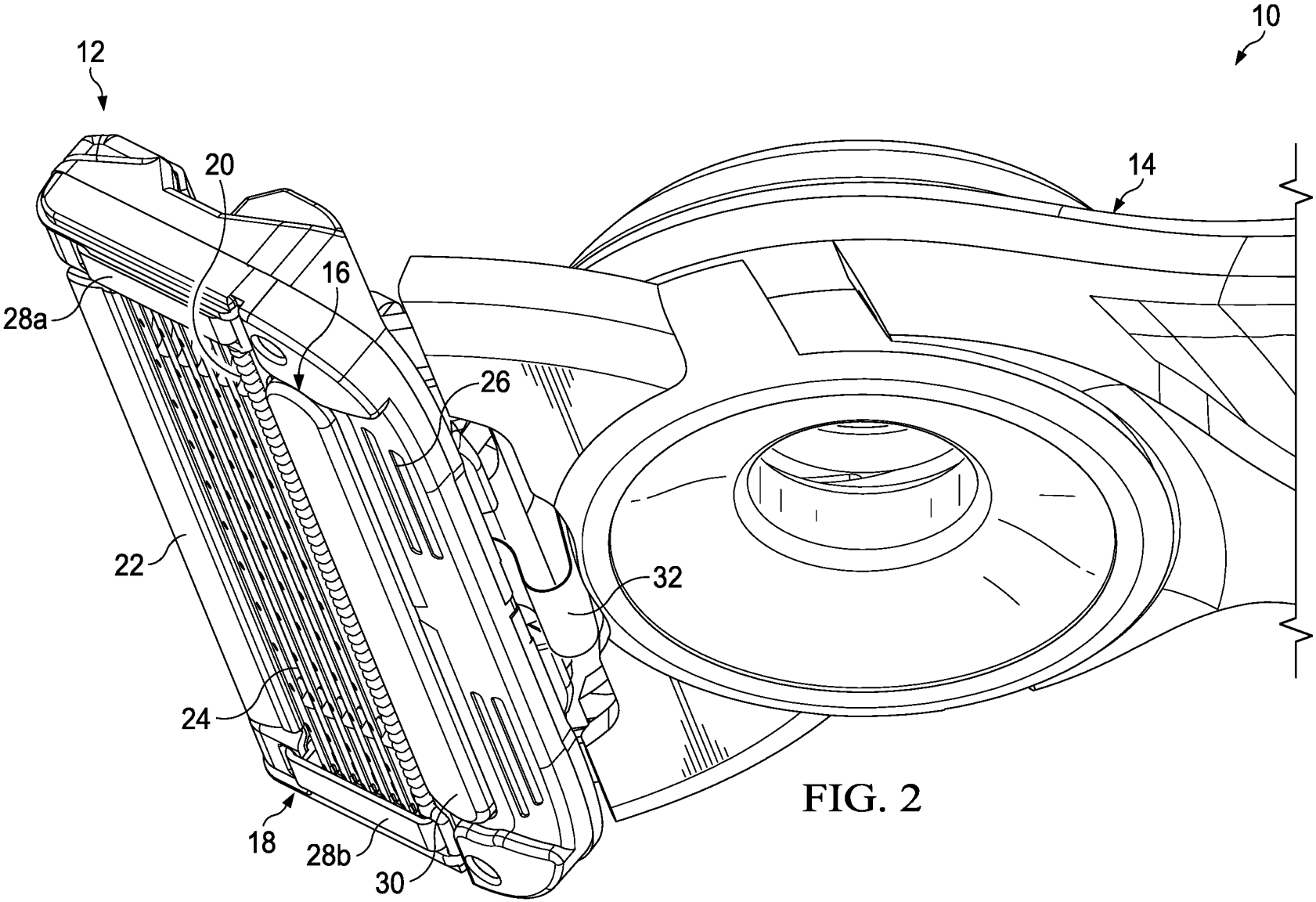
FIG. 2 is an enlarged perspective view of a portion of the shaving razor system of FIG. 1.

Referring to FIGS. 1 and 2, one possible embodiment of the present disclosure is shown illustrating a shaving razor system 10. FIG. 1 is a bottom view of the shaving razor system 10. It is understood that the shaving razor system 10 may also include other electronic personal care products, such as toothbrushes, electric razors, or other products that require an electrical connection. FIG. 2 is an enlarged view of a portion of the shaving razor system 10. In certain embodiments, the shaving razor system 10 may include a shaving razor cartridge 12 mounted to a handle 14. The shaving razor cartridge 12 may be fixedly or pivotably mounted to the handle 14, depending on the overall desired cost and performance of the shaving razor system 10. The handle 14 may hold a power source, such as one or more batteries (not shown) that supplies power to an electrical component 16 such as an energy emitting device, which may include heating elements, light emitting sources, motors and lasers. As will be explained in greater detail below, the electrical component 16 may be in electrical communication with the power source (not shown) via a flexible electrical bridge 32. The flexible electrical bridge 32 may extend from the handle 14 to the shaving razor cartridge 12. A portion of the flexible electrical bridge 32 may be exposed between the handle 14 and the shaving razor cartridge 12 (e.g., not in contact with the handle 14 or the shaving razor cartridge 12).

The shaving razor cartridge 12 may be permanently attached or removably mounted to the handle 14, thus allowing the shaving razor cartridge 12 to be replaced. Referring to FIG. 2, the shaving razor cartridge 12 may have a housing 18 with a guard 20, a cap 22, and one or more blades 24 mounted to the housing 18 between the cap 22 and the guard 20. The guard 20 may be toward a front portion of the housing 18 and the cap 22 may be toward a rear portion of the housing 18 (i.e., the guard 20 is in front of the blades 24 and the cap is behind the blades 24). The guard 20 and the cap 22 may define a shaving plane that is tangent to the guard 20 and the cap 22. The guard 20 may be a solid or segmented bar that extends generally parallel to the blades 24. In certain embodiments, the guard 20 may comprise a skin-engaging member 26 (e.g., a plurality of fins, grooves or an elastomeric pad) in front of the blades 24 for stretching the skin during a shaving stroke.

The skin-engaging member 26 may be insert injection molded or co-injection molded to the housing 18. However, other known assembly methods may also be used such as adhesives, ultrasonic welding, or mechanical fasteners. The skin engaging member 26 may be molded from a softer material (i.e., lower durometer hardness) than the housing 18. For example, the skin engaging member 26 may have a Shore A hardness of about 20, 30, or 40 to about 50, 60, or 70. A softer material may enhance skin stretching, as well as provide a more pleasant tactile feel against the skin of the user during shaving. A softer material may also aid in masking the less pleasant feel of the harder material of the housing 18 and/or the fins against the skin of the user during shaving.

In certain embodiments, the blades 24 may be mounted to the housing 18 and secured by one or more clips 28*a* and 28*b*. Other assembly methods known to those skilled in the art may also be used to secure and/or mount the blades 24 to the housing 18 including, but not limited to, wire wrapping, cold forming, hot staking, insert molding, ultrasonic welding, and adhesives. The clips 28*a* and 28*b* may comprise a metal, such as aluminum for acting as a sacrificial anode to help prevent corrosion of the blades 24. Although five blades 24 are shown, the housing 18 may have more or fewer blades depending on the desired performance and cost of the shaving razor cartridge 12.

Figure 10:
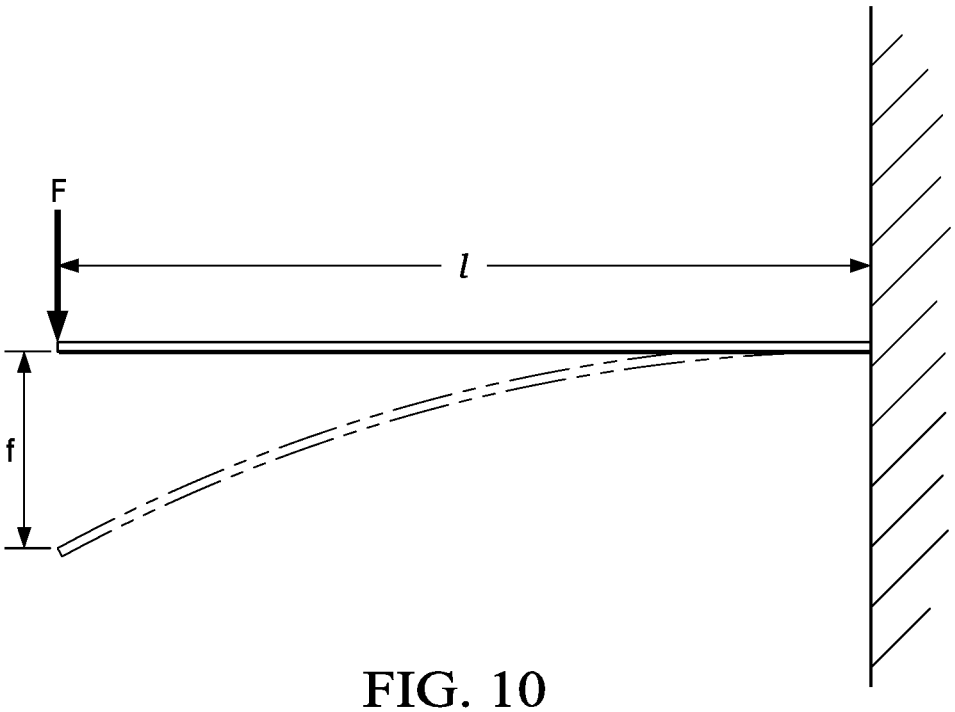
FIG. 10 is a view of a free body diagram.

In certain embodiments, it may be desirable to provide heat in front of the blades 24. For example, the electrical component 16 may be positioned in front of the guard 20 and behind the skin engaging member 26. The electrical component 16 may comprise a skin contacting surface 30 (e.g., a face plate) that delivers heat to a consumer's skin during a shaving stroke for an improved shaving experience. As will be described in greater detail below, the electrical component 16 may be mounted to either the shaving razor cartridge 12 or to a portion of the handle 14. As will be illustrated in greater detail below, the electrical component 16 may be in electrical communication with a power circuit (not shown) via the flexible electrical bridge 32. The flexible electrical bridge 32 may have electrical tracks to transfer electrical signals and current between the handle 14 and the shaving razor cartridge 14. The flexible electrical bridge 32 may extend from the handle 14 to the shaving razor cartridge 12. At least a portion 35 (shown in FIG. 3) of the flexible electrical bridge 32 may be positioned within the shaving razor cartridge 12 and at least a portion 37 positioned within the handle 14. The flexible electrical bridge 32 may have at least one electrical track to transfer electrical current. In certain embodiments, the electrical track may comprise copper. In certain embodiments, the flexible electrical bridge 32 may have a bending stiffness per width of about 0.07 Nmm to about 0.2 Nmm to allow sufficient flexibility of the flexible electrical bridge 32 during assembly. The bending stiffness may be calculated by a one-sided clamped bending beam method as shown below and in FIG. 10.

F=S*f, with the bending stiffness $$S = \frac{3 * E * I_y}{l^3}$$

F=force
l=length
f=displacement at l
E=modulus of elasticity
$I_y$=moment of Inertia The cap 22 may be a separate molded (e.g., a shaving aid filled reservoir) or extruded component (e.g., an extruded lubrication strip) that is mounted to the housing 18. In certain embodiments, the cap 22 may be a plastic or metal bar to aid in supporting the skin and define the shaving plane. The cap 22 may be molded or extruded from the same material as the housing 18 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Figure 3:
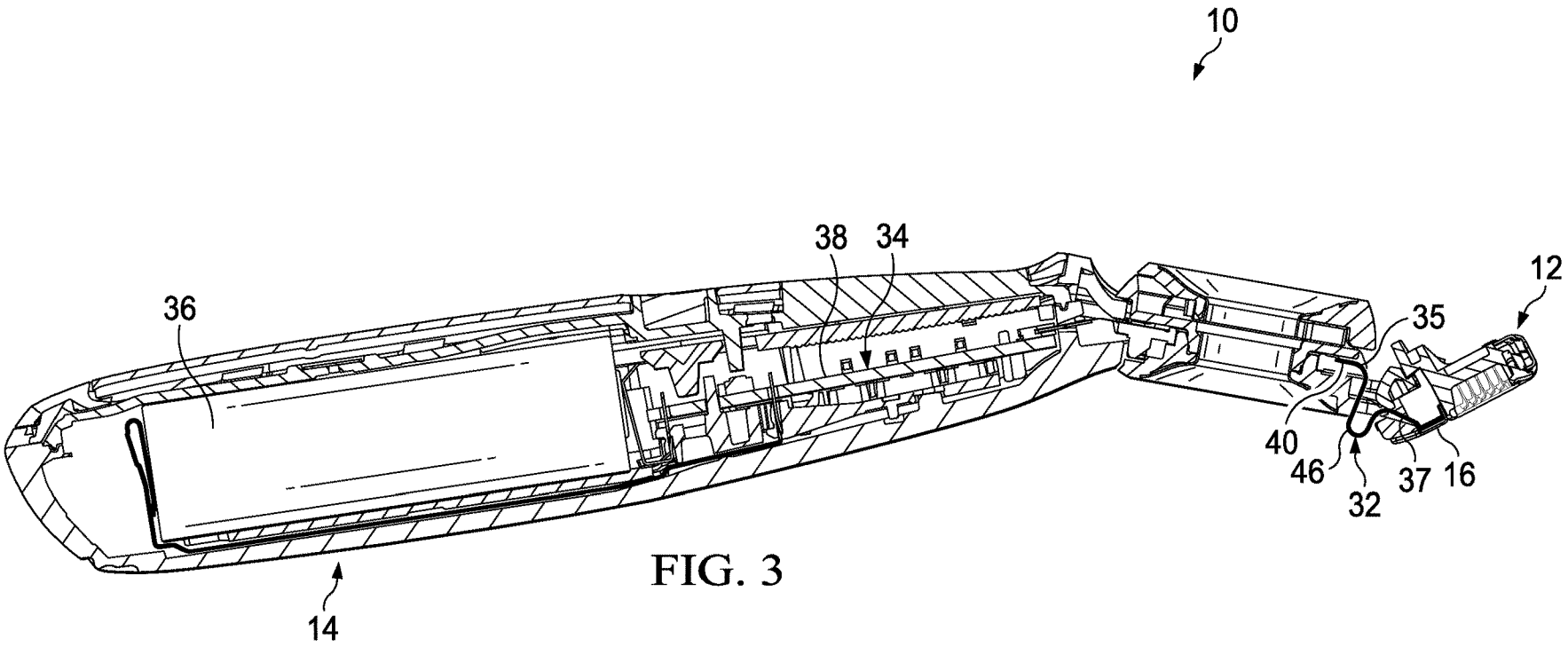
FIG. 3 is a cross section view of the shaving razor system, taken generally along the line 3-3 of FIG. 1.

Referring to FIG. 3, a cross section view of the shaving razor system 10 of FIG. 1 is illustrated. The shaving razor system 10 may include an electrical system 34 having a power source 36 in electrical communication with a circuit board 38 that is in electrical communication with the flexible electrical bridge 32. In certain embodiments, the power source 36 may be a lithium rechargeable battery. The printed circuit board 38 may include a micro-controller (not shown) that controls various operations of the electrical system, such as controlling LEDs or the heat level of the electrical component 16 (see FIG. 2). The flexible electrical bridge 32 may have a portion 35 positioned within the handle 14, a portion 35 positioned within the cartridge 12 and a loop 46 (e.g., a partly open curve within itself) that is positioned outside the handle 14 and the cartridge 12. It is understood that the loop 46 may not cross over itself. The loop 46 may allow the shaving razor cartridge 12 to be positioned on a different plane than a longitudinal axis of the handle 14, thus allowing for an improved shaving angle (e.g., angle of shaving plane relative to longitudinal axis of the handle 14) and pivoting range of the shaving razor cartridge 12 (FIG. 1).

Figure 4A:
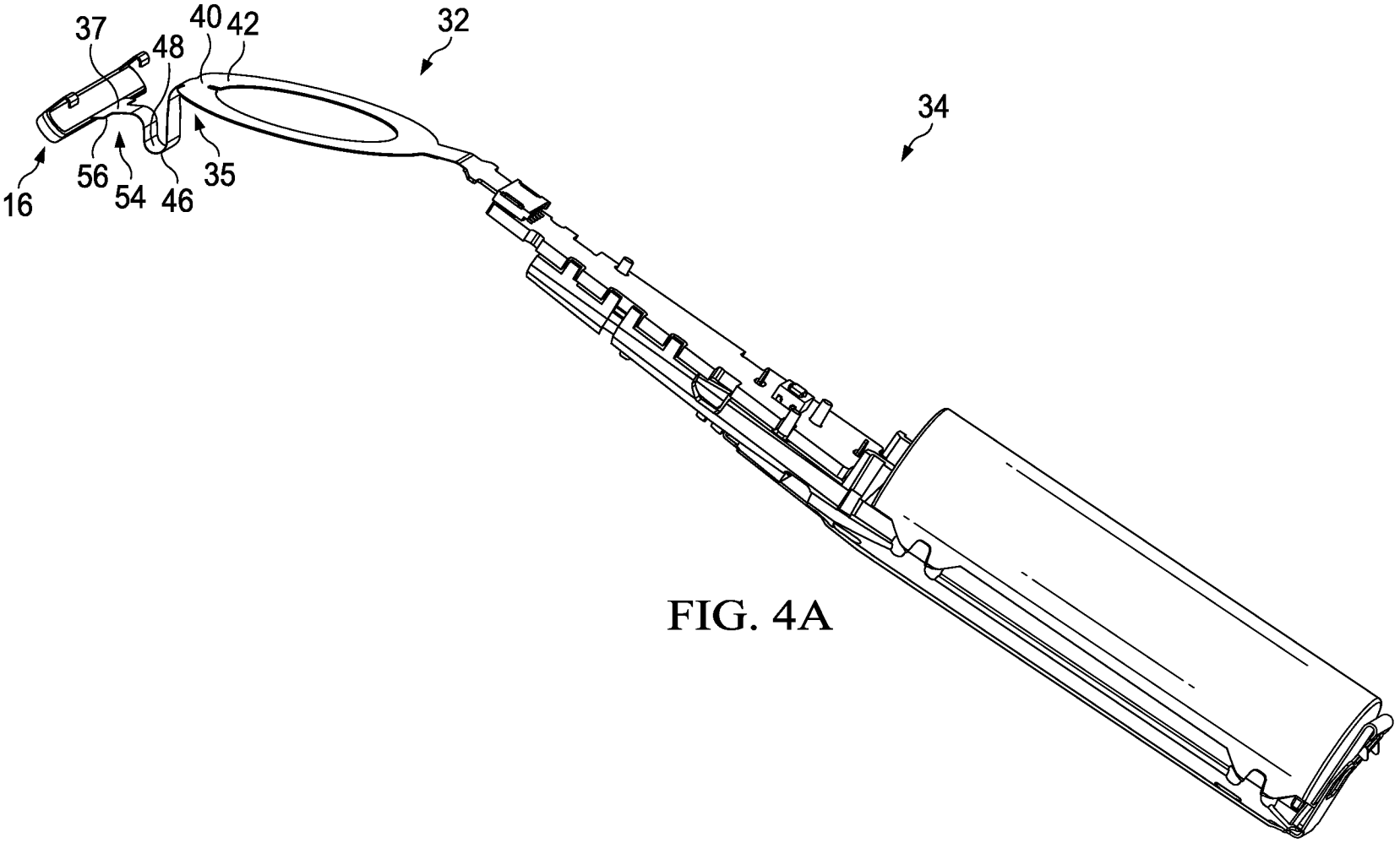
FIG. 4A is a top perspective view of an electrical system that may be incorporated into the shaving razor system of FIG. 1.
Figure 4B:
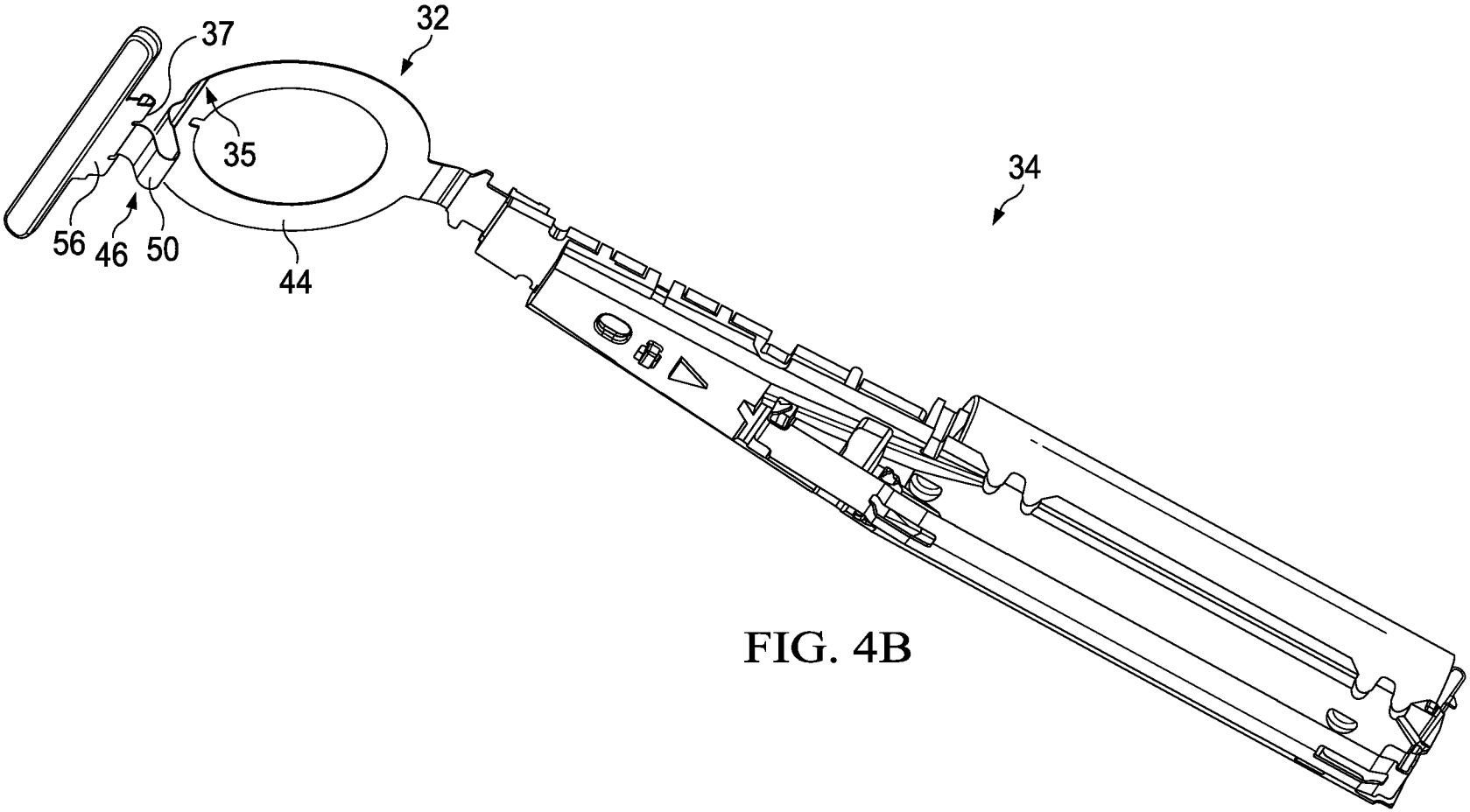
FIG. 4B is a bottom perspective view of the electrical system of FIG. 4A.

Referring to FIGS. 4A and 4B a top perspective view and a bottom perspective view of the electrical system 34 is illustrated. As will be explained in greater detail below, the flexible electrical bridge 32 may have at least one loop having a minimum radius to decrease stresses in the electrical bridge 32 as it is flexed and twisted in different directions. The flexible electrical bridge 32 may have a generally flat portion 40 (i.e., portion 35 positioned within the handle 14) with a top surface 42 and a bottom surface 44. The generally flat portion 40 may extend to a loop 46 that is positioned outside of the handle 14 and spaced apart from the shaving razor cartridge 12, as shown in FIG. 3. As will be described in greater detail below, the loop 46 may be formed during an assembly of the handle 14 (FIG. 1). The loop 46 may have a concave top surface 48 and a convex bottom surface 50. For example, the convex bottom 50 surface may face generally the same direction as the blades 24. However, it is understood the top surface 48 may be convex or concave depending on the positioning of the shaving razor cartridge 12 relative to the handle 14. The portion 35 positioned within the handle 14 (FIG. 1) may be connected to the electrical component 16. For example, the portion 35 may be mounted to a plate 56 on the electrical component 16. The plate 56 may comprise a metal such as aluminum or steel to stiffen the second end for providing a more secure attachment of the flexible electrical bridge 32 to the electrical component 16. In certain embodiments, an overall length of the flexible electrical bridge 32 may be about 5% to about 20% longer in a pre-assembled state compared to an assembled state having the loop 46. The loop 46 may provide for sufficient slack of the flexible electrical bridge 32 to accommodate manufacturing tolerances and excessive pivoting or rotation of the shaving razor cartridge 12 relative to the handle 14.

Figure 5:
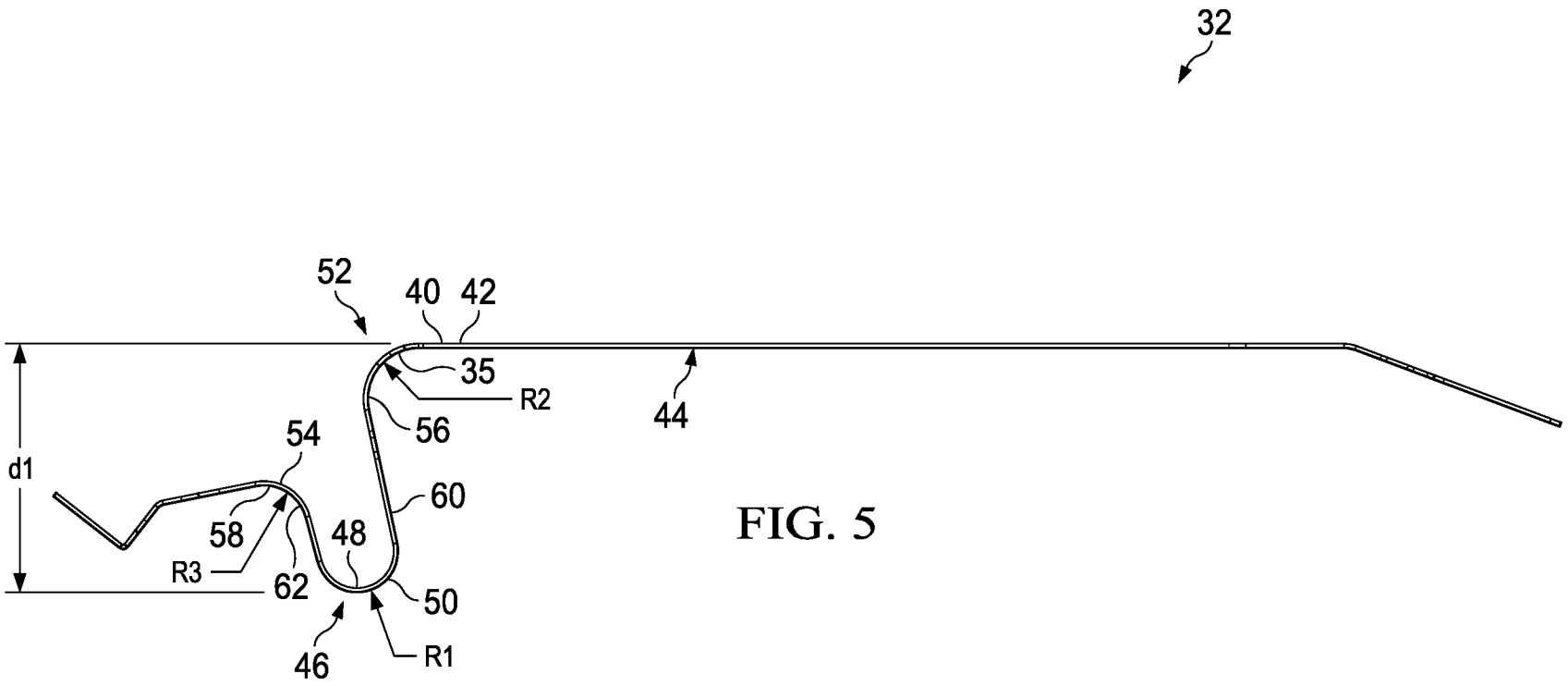
FIG. 5 is a side view of the flexible electrical bridge of FIG. 4A.

Referring to FIG. 5, a side view of the flexible electrical bridge 32 is shown. In certain embodiments, the loop 46 may have a total thickness that is less than a thickness of the generally flat portion 40 (i.e., the portion 37 positioned within the handle 14). For example, the thickness of the loop 46 may be about 0.05 mm to about 0.1 mm and the thickness of the portion 37 positioned with the handle 14 may be about 0.1 mm to about 0.3 mm. The flexible electrical bridge 32 may comprise at least one or more layers of polyimide, adhesive and copper. The loop 46 may be thinner to allow for greater flexibility. The generally flat portion 40 may not need to be as flexible because it is positioned within the handle and may be subject to lower stresses. The bottom surface 50 of the loop 46 may have a radius R1 greater than 1 mm. For example, R1 may be about 1 mm to about 10 mm depending on the rotation or pivoting of the shaving razor cartridge 12 (FIG. 1). It is understood that the shaving razor cartridge 12 may pivot or rotate in more than one direction relative to the handle 14 (FIG. 1). Accordingly, the flexible electrical bridge 32 may bend, twist or both either independently or at the same time. Significant amounts of stress may be applied to the flexible electrical bridge as the cartridge pivots and rotates. The loop 46 may have a first position and a second position. The first position may be a neutral or rest position of the loop 46. The second position may be a flexed position (e.g., when the shaving razor cartridge 12 pivots relative to the handle 14) in which the radius R1 increases or decreases relative to the first position depending on the pivot or rotation of the cartridge. In certain embodiments, the radius R1 may be about 1 mm to about 5 mm in the first position and about 1.5 mm to about 7 mm in the second position.

The flexible electrical bridge 32 may have a first bend 52 in a neutral position with a radius "R2" and a second bend 54 in a neutral position (as shown) with a radius "R3". The loop 46 may be positioned between the first bend 52 and the second bend 54. The first bend 52 may have a bottom surface 56 that is concave in the neutral position. It is understood that during pivoting of the shaving razor cartridge 12, the first bend 52 may become straight or convex. In certain embodiments, the radius R2 may be greater than 1 mm. For example, R2 may be about 1 mm to about 10 mm depending on the rotation or pivoting of the shaving razor cartridge 12 (FIG. 1). The first bend 52 may have a first position and a second position. The first position may be a neutral or rest position of the first bend 52. The second position may be a flexed position in which the radius R2 increases or decreases relative to the first position depending on the pivot or rotation of the shaving razor cartridge 12 (FIG. 1). In certain embodiments, the radius R2 may be about 1 mm to about 5 mm in the first position and about 1.5 mm to about 10 mm in the second position. The second bend 54 may have a bottom surface 58 that is concave in the neutral position. It is understood that during pivoting of the shaving razor cartridge 12, the second bend 54 may become straight or convex. In certain embodiments, the radius R3 may be greater than 1 mm. For example, R3 may be about 1 mm to about 10 mm depending on the rotation or pivoting of the shaving razor cartridge 12 (FIG. 1). The second bend 54 may have a first position and a second position. The first position may be a static or rest position of the second bend 54. The second position may be a flexed position in which the radius R3 increases or decreases relative to the first position depending on the pivot or rotation of the shaving razor cartridge 12 (FIG. 1). In certain embodiments, the radius R3 may be about 1 mm to about 5 mm in the first position and about 1.5 mm to about 10 mm in the second position. However, the radius R3 may also be straight or convex in the second position depending on how much the cartridge 12 is pivoted. In certain embodiments, R1 may be less than R2 and R3.

The flexible electrical bridge 32 may have a first leg 60 between the first bend 52 and the loop 46. A second leg 62 may be positioned between the second bend 54 and the loop 46. The first leg 60 and the second leg 62 may be generally straight. In certain embodiments, the first leg 60 may be longer than the second leg 62 to facilitate proper positioning of flexible electrical bridge 32 relative to the shaving razor cartridge 12 (FIG. 1). The first leg 60 and the second leg 62 may give the loop 46 a generally "U" shape profile.

In addition, the entrance of the flexible electrical bridge to the shaving razor cartridge 12 does not need to be on the same plane as a pivot axis of the shaving razor cartridge. Accordingly, the loop 46 allows for increased design flexibility for the location of the pivot axis without negatively impacting the performance of the flexible electrical bridge 32. The longitudinal axis of the handle 14 may extend generally along the bottom surface 44 of the generally flat portion 40 the flexible electrical bridge 32. The top surface 48 of the loop 46 may be positioned a vertical distance "d1" below the bottom surface 44 of the generally flat portion 40 of the flexible electrical bridge 32. The loop 46 may not significantly impact biasing forces of the shaving razor cartridge 12 as it pivots relative to the handle 14 (e.g., compared to a straight flexible electrical bridge). In certain embodiments, d1 may be about 5 mm to about 10 mm.

Figure 6:
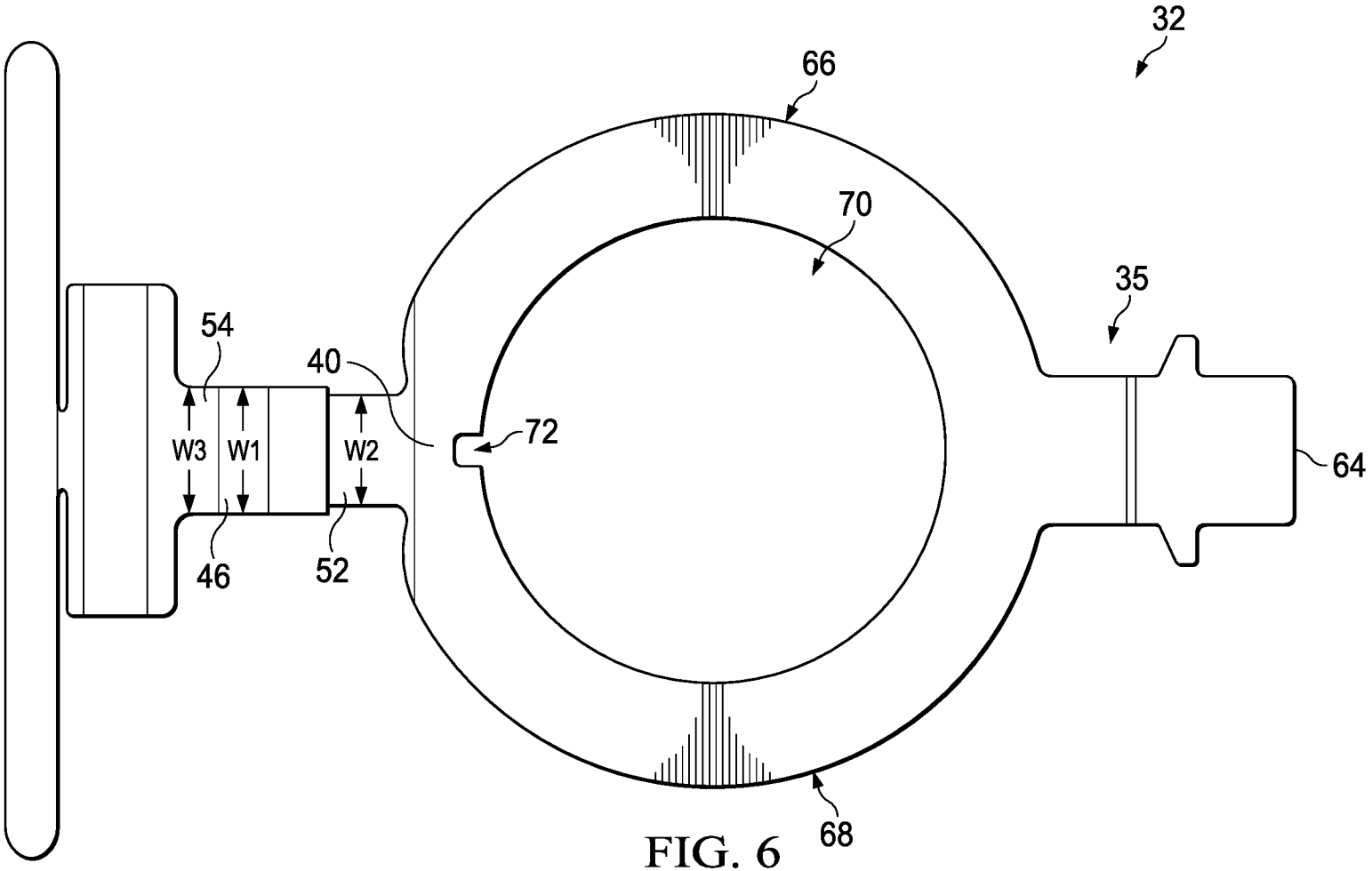
FIG. 6 is a top view of a flexible electrical bridge that may be incorporated into the electrical system of FIG. 4.

Referring to FIG. 6, a top view of the flexible electrical bridge 32 is shown. An electrical connector 64 may be positioned at an end of the flexible electrical bridge 32. The electrical connector 64 may connect the flexible electrical bridge 32 to the circuit board 38 (FIG. 3). In certain embodiments, the flexible electrical bridge 32 may be bifurcated. For example, the first bend 52 may extend in a first direction toward the loop 46 and in another direction to a pair of spaced apart arms 66 and 68 that extend around an opening 70 and merge back together before the electrical connector 64. The flexible electrical bridge 32 may have a notch 72 configured to engage a corresponding portion of the handle 14, such as a post 75 (see FIG. 7) to properly locate the flexible electrical bridge 32 during assembly. The loop 46 may have a first width "w1" of about 3 mm to about 6 mm and more preferably about 4 mm to about 5 mm. The first bend 52 may have a width "w2" that is less than w1. For example, w2 may be about 3 mm to about 4 mm. In certain embodiments, the first bend 52 may form a neck (e.g., have a smaller width in the middle than at either end). For example, the width "w2" of the first bend 52 may be less than the width "w1" at one end of the first bend 52 and less than a width at another end of the first bend 52 toward the arms 66 and 68. In certain embodiments, the first bend 52 of the flexible electrical bridge 32 may have a smaller width than the loop 46 to better accommodate stresses associated with bending and twisting of the flexible electrical bridge 32. The second bend 54 may have a width "w3" that is the same as "w1".

Flexible electrical bridges are commonly used to connect electrical components in electrical devices that are not on the same printed circuit board (e.g., placed in different locations of the electrical device). In such applications, the flexible electrical bridge may be static, and flexibility may only be required to accommodate different locations in space, but not relative movement of the connected electrical components. In other devices, such as ink jet printers, one component (e.g., the print head) may move in a linear motion relative to a second fixed electrical component (e.g., a printed circuit board). Accordingly, the flexible electrical bridge may change shape from being flat to U shaped to accommodate changes in distance as components move in a linear direction. Shaving razor cartridges typically pivot relative to a handle (e.g., FIG. 1) in a non-linear fashion. The flexible electrical bridge 32 flexes to change distance on a circular path, which may be accomplished by reducing and increasing one or more radii of the flexible electrical bridge 32 (e.g., a radius of the loop 46). If the loop 46 was straight, the pivoting of the cartridge 12 relative to the handle 14 may cause increased and uncontrolled stress on the flexible electrical bridge 32. The added stress may result in breaking any electrical connections on the flexible electrical bridge 32.

Figure 7:
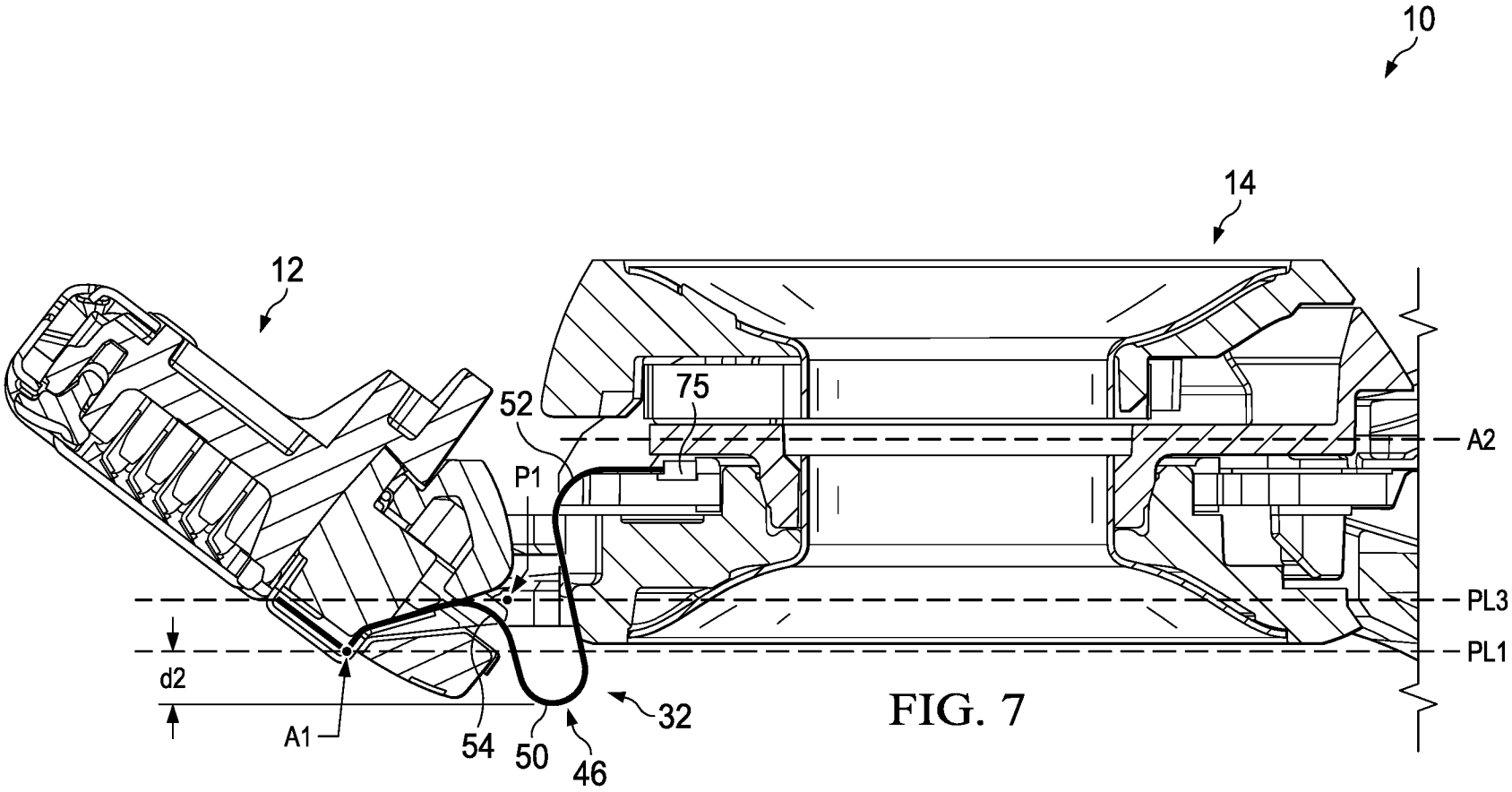
FIG. 7 is an enlarged partial view of FIG. 3.

Referring to FIG. 7 an enlarged partial cross section view of the shaving razor system 10 is illustrated. In certain embodiments, the shaving razor system 10 may allow for the shaving razor cartridge 12 to pivot (relative to the handle 14) about more than one axis. For example, the shaving razor system 10 may have a primary pivot axis A1 (e.g., extending into the page) about which the shaving razor cartridge 12 pivots. The primary pivot axis A1 may be transverse to a secondary pivot axis A2. In certain embodiments, a plane PL1 may extend through the primary pivot axis A1 and may be parallel to the secondary pivot axis A2. More modern shaving razors may have more than one pivot axis to improve contact with the skin, especially for shaving contoured areas of the face and body. However, multiple pivot points may add significant stress to electrical connections between the handle and the cartridge. Electrical connections may also be subjected to increased stress if a connection point at the cartridge is not aligned with the electrical connection. For example, the flexible electrical bridge 32 may enter the shaving razor cartridge 12 at a point P1 that lies on a plane PL3. The plane PL3 may be parallel to PL1 and offset from PL1. Accordingly, the point P1 may not lie on the same plane as the primary pivot axis A1 (e.g., P1 may lie on the flexible electrical bridge 32). The loop 46 may aid in decreasing stress on the flexible electrical bridge 32 in both a static and dynamic positions of the shaving razor cartridge 12. Accordingly, the flexible electrical bridge 32 may withstand thousands of cycles of the shaving razor cartridge 12 pivoting relative to the handle 10 without failure or damage to any electrical connections on the flexible electrical bridge 32. The bottom surface 50 of the loop 46 may be spaced apart from the plane PL1 of the primary pivot axis A1 by a vertical distance "d2" of about 0.5 mm to about 2.0 mm. The first and second bends 52 and 54 may also contribute to decreasing the stress on the flexible electrical bridge 32 by providing a more forgiving assembly. The loop 46 allows more flexibility in a vertical position compared to a straight section of the flexible electrical bridge 32.

Figure 8:
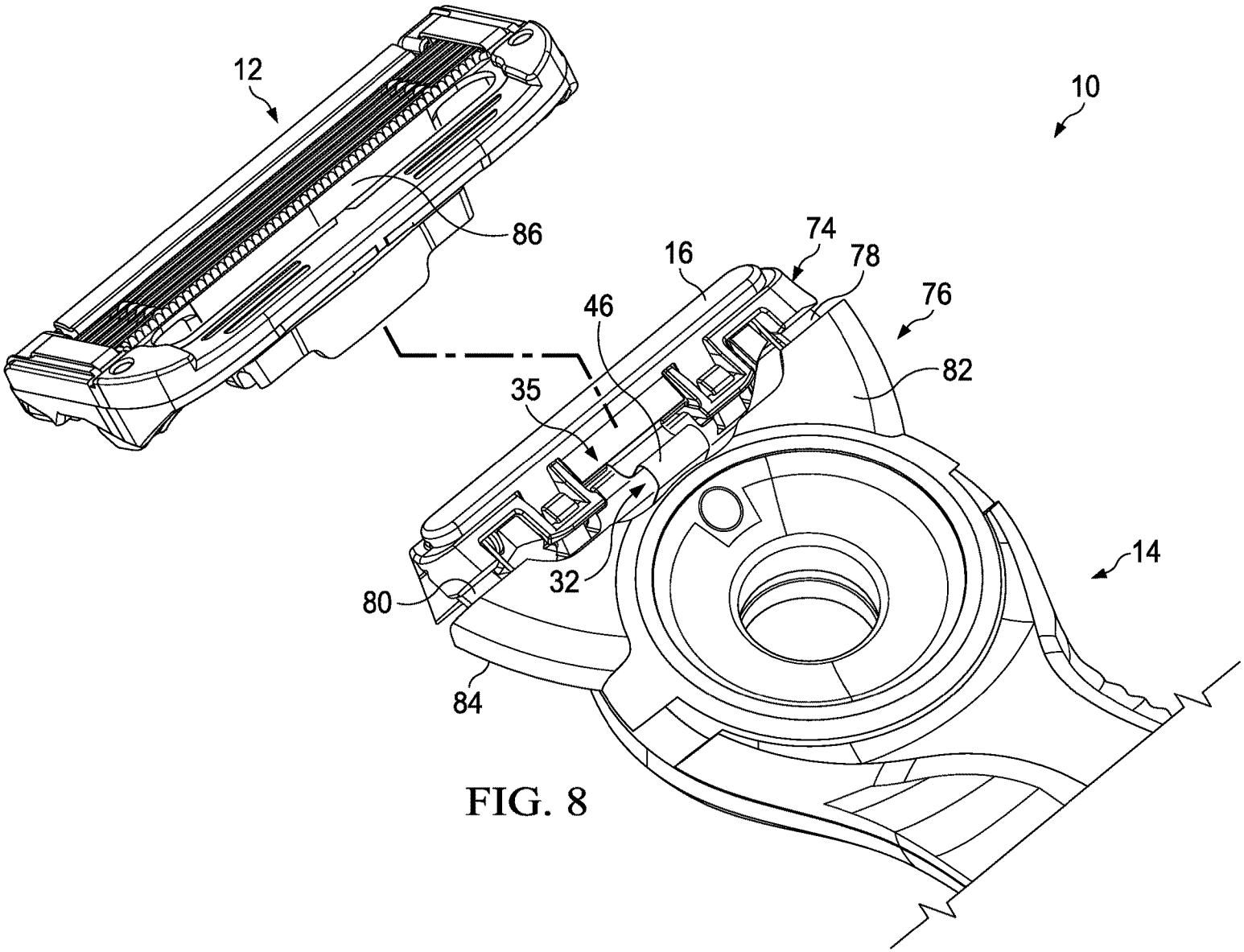
FIG. 8 is a perspective assembly view of the shaving razor system.

Referring to FIG. 8, an enlarged partial perspective view of the shaving razor system 10 is shown. In certain embodiments, the shaving razor cartridge 12 may be removable from a cartridge connector 74. The cartridge connector 74 may attach to a proximal end 76 of the handle 14. For example, a pair of arms 78 and 80 on the cartridge connector 74 may engage a corresponding arm 82 and 84 of the handle 14. In certain embodiments, the cartridge connector 74 may pivot relative to the handle 14. Accordingly, when the cartridge 12 is mounted to the cartridge connector 74, the cartridge 12 may pivot along with the cartridge connector 74. The energy emitting device 16 may be received within an opening 86 in the shaving razor cartridge 12. As shown in FIG. 8, the flexible electrical bridge 32 may still have the loop 46 when the shaving razor cartridge 12 is disconnected from the handle 14 (e.g., cartridge connector 74). The portion 35 of the flexible electrical bridge 32 may be positioned within the shaving razor cartridge 12 when the shaving razor cartridge 12 is mounted to the handle 14 (e.g., cartridge connector 74).

Figure 9A:
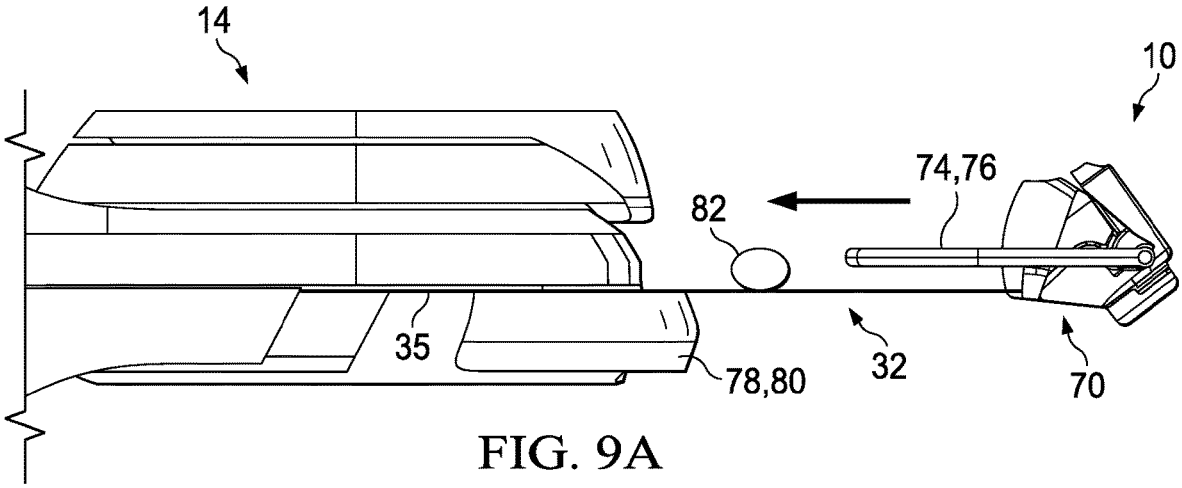
FIG. 9A is a partial side assembly view of a portion of the shaving razor system.
Figure 9B:
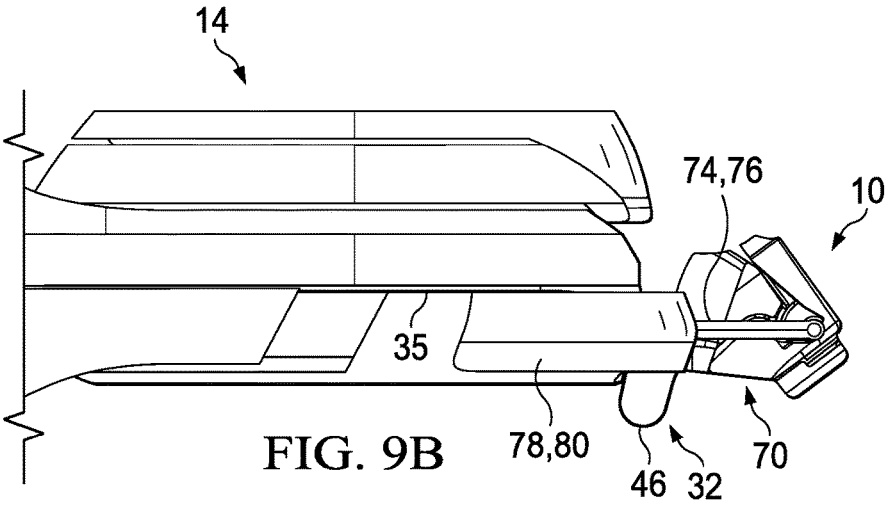
FIG. 9B is a partial side view of the shaving razor system.

Referring to FIGS. 9A and 9B, side views of the shaving razor system 10 are shown in one possible unassembled and one possible assembled position, respectively. In certain embodiments, the flexible electrical bridge 32 may be fixed to the handle 14, such that at least the portion 37 of the flexible electrical bridge 32 is positioned within the handle 14. The flexible electric bridge 32 may then be fixed to the cartridge connector 70. The flexible electrical bridge 32 may be generally straight prior to the cartridge connector 70 being mounted to the handle 14. However, the flexible electrical connector 32 may bend and the loop 46 may be formed when the cartridge connector 70 is mounted and fixed to the handle 14, as shown in FIG. 9B. The cartridge connector 70 may be moved toward the handle 14, as indicated by the arrow in FIG. 9A. The arms 78 and 80 of the handle 14 may be configured to receive and fix in place the corresponding arms 74, 76 of the cartridge connector 70. A fixture 82 may contact and apply force against the flexible electrical bridge 32 to bend the flexible electrical bridge 32 so the loop 46 is formed in the proper direction. Once the cartridge connector 70 is mounted to the handle 14, the loop 46 may be permanent and the fixture 82 may be removed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:
a handle;
a shaving razor cartridge mounted to the handle; and
a flexible electrical bridge having a portion positioned within the handle and extends from the handle to the shaving razor cartridge, wherein the flexible electrical bridge has a loop between the shaving razor cartridge and the handle and wherein the loop is positioned outside the handle and the shaving razor cartridge, wherein a bottom surface of the loop has a radius of 1 mm to 10 mm.

2. The shaving razor system of claim 1 wherein the loop has a top surface and a bottom surface, wherein the top surface of the loop is concave in a neutral position.

3. The shaving razor system of claim 1 wherein the loop has a first position with a radius that is less than a radius of the loop in a second position.

4. The shaving razor system of claim 1 wherein a top surface of the loop is positioned a vertical distance of 5 mm to 10 mm below a bottom surface of a portion of the flexible electrical bridge positioned within the handle.

5. The shaving razor system of claim 1 wherein the flexible electrical bridge has a first bend with a width that is less than the width of the loop.

6. The shaving razor system of claim 5 wherein the first bend is positioned between the shaving razor cartridge and the handle.

7. The shaving razor system of claim 1 wherein the flexible electrical bridge has a first bend and a second bend and the loop is positioned between the first bend and the second bend.

8. The shaving razor system of claim 1 wherein loop is spaced apart from the cartridge.

9. A shaving razor system comprising:
a handle;
a shaving razor cartridge mounted to the handle; and
a flexible electrical bridge having a portion positioned within the handle and extends from the handle to the shaving razor cartridge, wherein the flexible electrical bridge has a loop between the shaving razor cartridge and the handle and wherein the loop is positioned outside the handle and the shaving razor cartridge, wherein the loop has a width of 3 mm to 6 mm.

10. The shaving razor system of claim 9 wherein the loop has a top surface and a bottom surface, wherein the top surface of the loop is concave in a neutral position.

11. The shaving razor system of claim 9 wherein the loop has a first position with a radius that is less than a radius of the loop in a second position.

12. The shaving razor system of claim 9 wherein a top surface of the loop is positioned a vertical distance of 5 mm to 10 mm below a bottom surface of a portion of the flexible electrical bridge positioned within the handle.

13. The shaving razor system of claim 9 wherein the flexible electrical bridge has a first bend with a width that is less than the width of the loop.

14. The shaving razor system of claim 13 wherein the first bend is positioned between the shaving razor cartridge and the handle.

15. The shaving razor system of claim 9 wherein the flexible electrical bridge has a first bend and a second bend and the loop is positioned between the first bend and the second bend.

16. The shaving razor system of claim 9 wherein loop is spaced apart from the cartridge.

17. A shaving razor system comprising:
a handle;
a shaving razor cartridge mounted to the handle; and
a flexible electrical bridge having a portion positioned within the handle and extends from the handle to the shaving razor cartridge, wherein the flexible electrical bridge has a loop between the shaving razor cartridge and the handle and wherein the loop is positioned outside the handle and the shaving razor cartridge, wherein a first bend has a radius of about 1 mm to about 5 mm in a first position and a second bend has a radius of about 2 mm to about 4 mm in a first position.

18. The shaving razor system of claim 17 wherein loop is spaced apart from the cartridge.

19. The shaving razor system of claim 17 wherein the loop has a top surface and a bottom surface, wherein the top surface of the loop is concave in a neutral position.

20. The shaving razor system of claim 17 wherein the loop has a first position with a radius that is less than a radius of the loop in a second position.

* * * * *